US006692183B2

(12) United States Patent
Godfrey

(10) Patent No.: US 6,692,183 B2
(45) Date of Patent: Feb. 17, 2004

(54) HYDRAULICALLY ADJUSTABLE MANHOLE RING

(76) Inventor: Steven A. Godfrey, N7347 Nine Indian Trail, Elkhorn, WI (US) 53121

( * ) Notice: Subject to any disclaimer, the term of this patent is extended or adjusted under 35 U.S.C. 154(b) by 0 days.

(21) Appl. No.: 10/259,265

(22) Filed: Sep. 28, 2002

(65) Prior Publication Data

US 2003/0081999 A1 May 1, 2003

Related U.S. Application Data

(60) Provisional application No. 60/325,983, filed on Sep. 28, 2001.

(51) Int. Cl.[7] ..... E02D 29/14
(52) U.S. Cl. ..... 404/26; 404/25
(58) Field of Search ..... 404/25, 26

(56) References Cited

U.S. PATENT DOCUMENTS 3,390,224 A * 6/1968 Wyatt ..... 174/37
3,930,739 A 1/1976 Larsson et al.
4,038,789 A 8/1977 Axgarde et al.
4,075,796 A 2/1978 Cuozzo
4,097,171 A 6/1978 Fier
4,188,151 A * 2/1980 Hall ..... 404/26
4,225,266 A 9/1980 Fier
4,273,467 A 6/1981 Cronk
4,281,944 A 8/1981 Bowman
4,337,005 A 6/1982 LeBaron
4,466,219 A 8/1984 Campolito
4,536,103 A 8/1985 Prescott
4,582,450 A 4/1986 Neil
4,666,333 A 5/1987 Armstrong
4,673,310 A 6/1987 LeBaron
4,759,656 A * 7/1988 Wilson ..... 404/26
4,834,574 A 5/1989 Bowman
4,844,402 A 7/1989 Werner
4,867,601 A 9/1989 Bowman
4,906,128 A 3/1990 Trudel
4,995,757 A 2/1991 Prescott
5,044,818 A 9/1991 Pritchard
5,051,022 A 9/1991 Bowman
5,095,667 A 3/1992 Ryan et al.
5,143,478 A 9/1992 Bowman
5,165,819 A 11/1992 Bowman
5,184,912 A 2/1993 Bowman
5,209,601 A 5/1993 Odill et al.
5,211,504 A 5/1993 Trudel
5,221,155 A 6/1993 Neil
5,290,006 A 3/1994 Gouker
5,299,884 A * 4/1994 Westhoff et al. ..... 404/25

(List continued on next page.)

*Primary Examiner*—Gary S. Hartmann
(74) *Attorney, Agent, or Firm*—Michael Best & Friedrich LLP

(57) ABSTRACT

A hydraulically adjustable manhole ring including upper and lower rings formed to provide a channel there between. The channel is sealed by in inner flexible membrane coupled between the inner circumferences of the upper and lower rings and an outer flexible membrane coupled between the outer circumferences of the upper and lower rings. A flowable setting agent is injected into the channel causing the upper ring to move relative to the lower ring.

12 Claims, 12 Drawing Sheets

U.S. PATENT DOCUMENTS

| | | | | | |
|---|---|---|---|---|---|
| 5,328,294 | A | | 7/1994 | Miller | |
| 5,344,253 | A | | 9/1994 | Sacchetti | |
| 5,451,119 | A | | 9/1995 | Hondulas | |
| 5,462,386 | A | | 10/1995 | Prescott | |
| 5,470,172 | A | | 11/1995 | Wiedrich | |
| 5,511,897 | A | * | 4/1996 | House et al. | 404/25 |
| 5,513,926 | A | | 5/1996 | Prescott | |
| 5,564,855 | A | | 10/1996 | Anderson | |
| 5,595,455 | A | | 1/1997 | Svirklys | |
| 5,797,221 | A | * | 8/1998 | Young et al. | 52/20 |
| 5,899,024 | A | | 5/1999 | Stannard | |
| 5,934,820 | A | | 8/1999 | Hinkle | |
| 5,944,442 | A | | 8/1999 | Roush et al. | |
| 5,956,905 | A | | 9/1999 | Wiedrich | |
| 5,974,741 | A | | 11/1999 | Fukuhara | |
| 6,007,270 | A | | 12/1999 | Bowman | |
| 6,161,984 | A | | 12/2000 | Sinclair | |
| 6,179,518 | B1 | | 1/2001 | Suatac | |
| 6,196,760 | B1 | | 3/2001 | Sinclair | |
| 6,311,433 | B1 | | 11/2001 | Zdroik | |
| 6,371,687 | B1 | | 4/2002 | Heintz et al. | |
| 6,371,688 | B1 | | 4/2002 | Yang et al. | |
| 6,435,764 | B1 | | 8/2002 | McNeely | |
| 6,457,901 | B1 | | 10/2002 | Sondrup | |
| 6,520,713 | B2 | | 2/2003 | Sondrup | |
| 6,524,026 | B2 | | 2/2003 | Sondrup | |

* cited by examiner

HYDRAULICALLY ADJUSTABLE MANHOLE RING

CROSS-REFERENCE TO RELATED APPLICATIONS

This application claims priority under 35 U.S.C. §119 to Provisional Patent Application No. 60/325,983 filed Sep. 28, 2001.

BACKGROUND OF THE INVENTION

The present invention relates to manholes and particularly to manhole rings for raising and adjusting manhole and catch basin frames.

Sewer, water, electric and other underground utilities commonly require access structures to allow entry of men or equipment to perform inspection or maintenance. These structures are commonly called manholes. Manholes are typically constructed of a base, cylindrical barrel section(s), a cone section, one or more adjustment rings, and a metal frame and cover assembly. The top surface of the frame and cover assembly is generally desired to be flush with the ground surface (i.e., the surface of the road, sidewalk, etc.), both in elevation and horizontal slope. A typical method of adjusting the frame when constructing a manhole is to use one or more preformed plastic or concrete adjusting rings placed between the cone and frame to raise the top of the frame to the desired elevation. The preformed adjusting rings are generally available in nominal sizes of 2, 3, 4 or six inches in thickness. Thus, in many instances the exact elevation desired cannot be achieved using the preformed adjusting rings. A common practice is to use a combination of small cement or steel blocks and wedges to support the frame at the desired elevation and then pour or place cement into the created void, allowing it to set and provide support for the frame and cover assembly. This method of adjustment does not provide a uniform distribution or density of the cement, resulting in a material that is of potentially inadequate strength and one that may be prone to cracking and deterioration.

Another common situation requiring manhole frame adjustment is when a paved roadway is repaved or "overlaid" with a layer of asphalt. Existing manhole frame and cover assemblies must be raised a distance equal to the thickness of the pavement overlay to again be flush with the newly paved surface. A conventional method for raising a manhole assembly in this scenario involves removing the frame and placing a concrete or plastic adjusting ring on the existing manhole structure and then reinstalling the frame. This can be a time consuming task and generally requires at least two people to complete. Again, as previously described, meeting the exact elevation and slope can be difficult.

Other conventional methods to facilitate the positioning of the frame and cover assembly on the upper end of the manhole include arrangements of screw assemblies to raise the casting and arrangements of spacer rings placed on the existing frame as a spacer to allow the manhole cover to be reinstalled at a higher elevation. Yet another device consists of a plastic form and tool for cutting the form to proper elevation to allow the placement of concrete to form an adjustment ring on the upper end of the manhole. This process requires the manhole frame to be removed and then replaced after the concrete sets. A method and apparatus for adjusting manhole frames, which provides relatively accurate leveling of a manhole cover would be welcomed by users of manhole frames and assemblies.

SUMMARY OF THE INVENTION

The present invention provides a method and apparatus that positions a manhole frame in relation to the upper end of the manhole. The process utilizes a pressurized, flowable setting agent to lift the frame to the desired elevation and position and, when allowed to set or cure, provides a strong and permanent adjustment ring to support the frame and cover assembly. The device includes an upper and a lower ring of a rigid material, stacked one on top of the other and joined together on both their inner and outer perimeters with a flexible membrane or vertically movable containment wall. The mating surfaces of the upper and lower rings are configured to provide a cavity or channel there between. Further, an injection groove connecting the cavity or channel to an injection port on the inner surface of the apparatus facilitates the injection of the flowable setting agent into the cavity, between the upper and lower rings.

In preferred embodiments, the flexible membranes are continuous bands of a rubber or plastic material and are fastened to the upper and lower rings by adhesion or mechanical means. The bands are of sufficient width to allow the top ring to move upward a distance that is desired to be the maximum adjusting range for the device. Lateral support bands, cylindrical in shape and made of a rigid material such as HDPE or PVC are fastened by adhesion or mechanically to the inner surface of the inside flexible membrane to provide support during the pressurization process. A similar lateral support band can be fastened to the outer surface of the outside membrane to provide support during pressurization and to protect the membrane from possible abrasion from backfill material or damage during installation. The lateral support bands may be fastened to the inner and outer membranes using two congruent rigid bands, one slightly smaller in diameter than the other, one placed inside the other, with the membrane "sandwiched" between them. The lateral support bands are of a height approximately equal to the height of the stacked, unexpanded upper and lower ring assembly.

In preferred embodiments, the setting agent includes a cementitious mixture and the inner membrane has an injection port with a hose fitting to allow the injection of the cementitious mixture into the cavity of the device. The inner membrane also has a venting port which is connected to the cavity or channel by an evacuation groove to allow air to be forced out of the cavity when replaced by the cementitious mixture or other setting agent. The venting port can be plugged after the air has been evacuated, or fitted with a fabric membrane that will allow air to escape, but will retain he setting agent.

BRIEF DESCRIPTION OF THE DRAWINGS

The detailed description particularly refers to the accompanying figures in which:

FIG. 5 is a sectional view of the manhole ring of FIG. 1 taken along line 5—5 of FIG. 4, showing the manhole ring including an upper ring and a lower ring with the channel positioned there between;

DETAILED DESCRIPTION OF THE DRAWINGS

Figure 1:
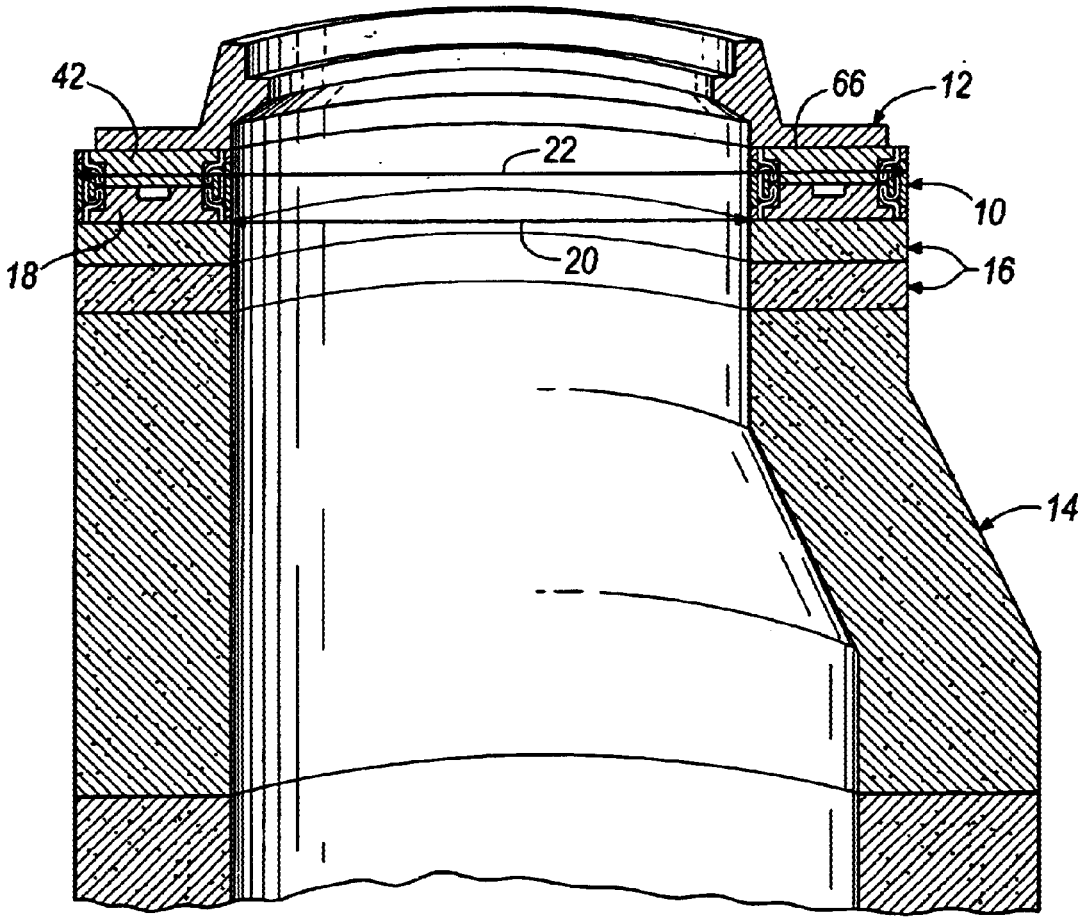
FIG. 1 is a sectional view of a hydraulically adjustable manhole ring according to the present invention positioned between a manhole frame and a manhole cone.
Figure 2:
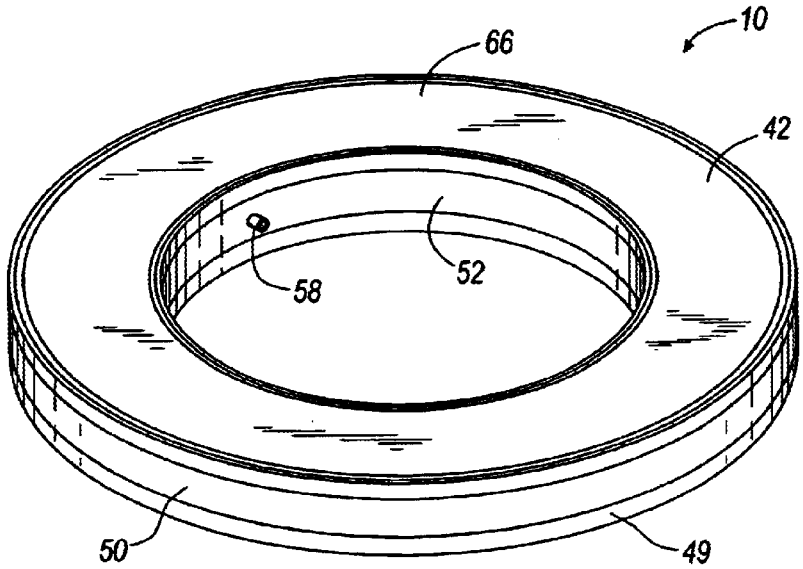
FIG. 2 is a perspective view of the manhole ring of FIG. 1 in a first position.
Figure 3:
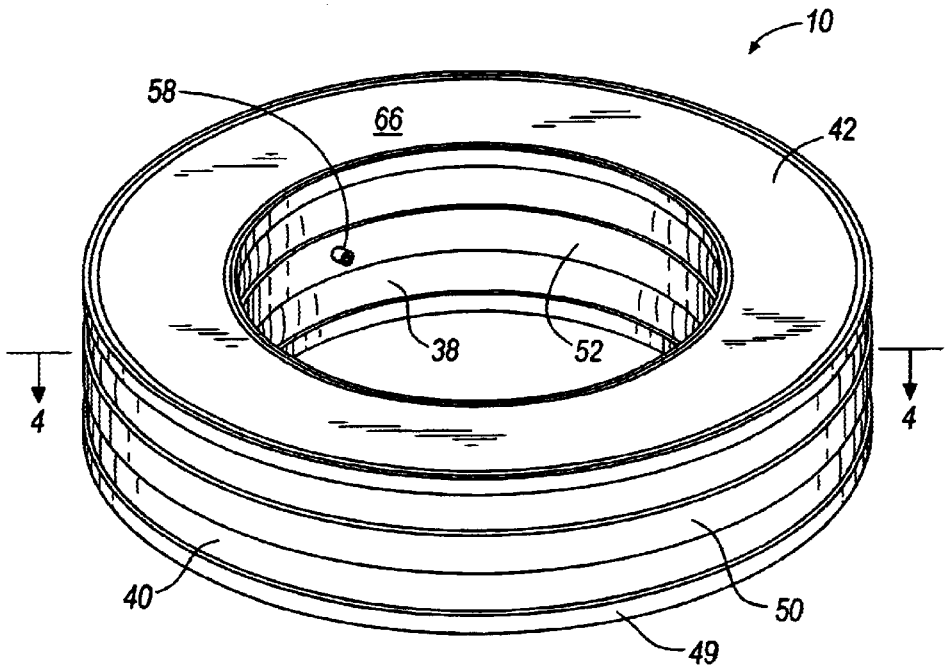
FIG. 3 is a perspective view of the manhole ring of FIG. 1 in a second, expanded position.
Figure 4:
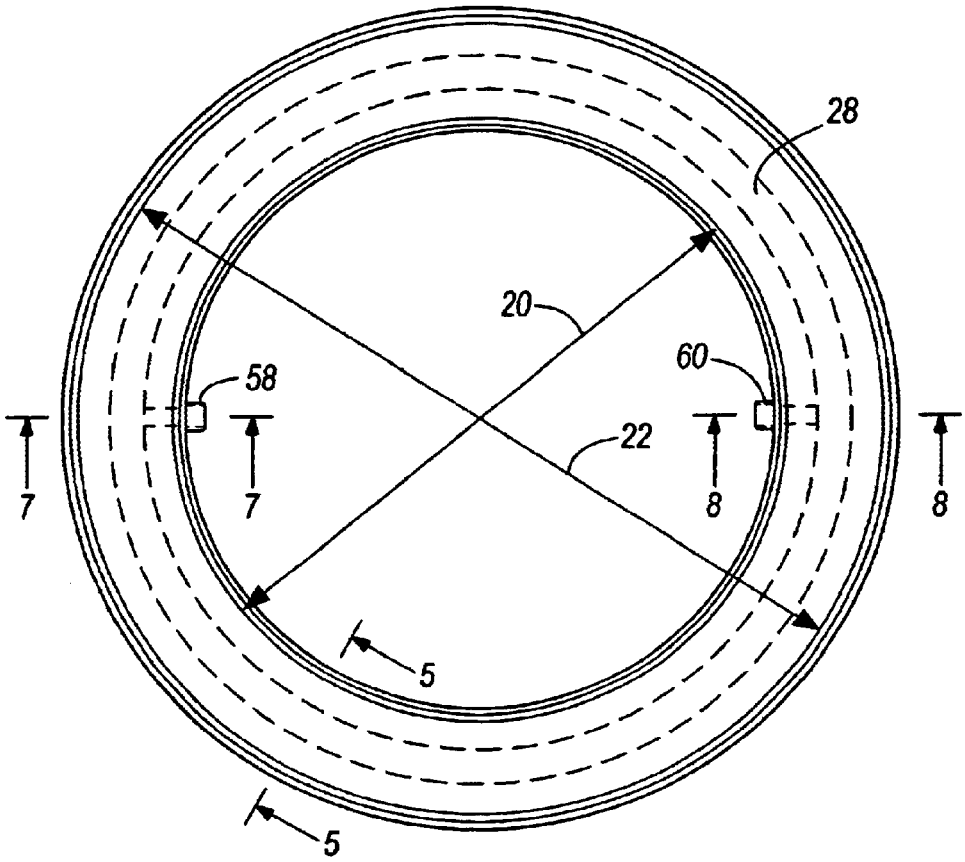
FIG. 4 is a top view of the manhole ring of FIG. 1 showing in dotted line a channel or cavity running entirely around the manhole ring.

Referring to FIG. 1, a hydraulically adjustable manhole ring 10, according to the present invention, is shown positioned between a manhole frame 12 and a manhole cone 14. Two standard adjustment rings 16 are also shown in FIG. 1. However, it will be readily apparent to those of ordinary skill in the art that the number and use of the standard manhole adjustment rings 16 is optional.

Referring to FIGS. 1–8, the hydraulically adjustable manhole ring 10 comprises a bottom ring or lower ring 18 (FIG. 5) that is "doughnut" shaped with inner and outer diameters 20 and 22, respectively, which are approximately the same as the diameters of the standard adjustment rings 16. A bottom surface 24 of the bottom ring 18 is substantially flat, and when in use is set on the manhole cone 14 or upper-most adjustment ring 16. A top surface 26 of the bottom ring 18 is substantially flat on the inner and outer circumferences and has a channel 28 formed in its midpoint circumference of suitable depth and width dimensions to facilitate flowing movement of an injected flowable setting agent 64, such as a cementitious mixture (e.g., cement, grout, etc.), an epoxy, or a urethane foam, etc. At one point on the inner flat surface is an injection groove 30 (FIG. 7) to facilitate injection of the flowable setting agent. At a point opposite the injection groove 30, is a smaller evacuation groove 32 (FIG. 8) to facilitate the evacuation of air during the injection process. Inner and outer vertical edges 34 and 36, respectively, provide a surface to attach a lower end of an inner membrane 38 and an outer membrane 40.

Figure 16:
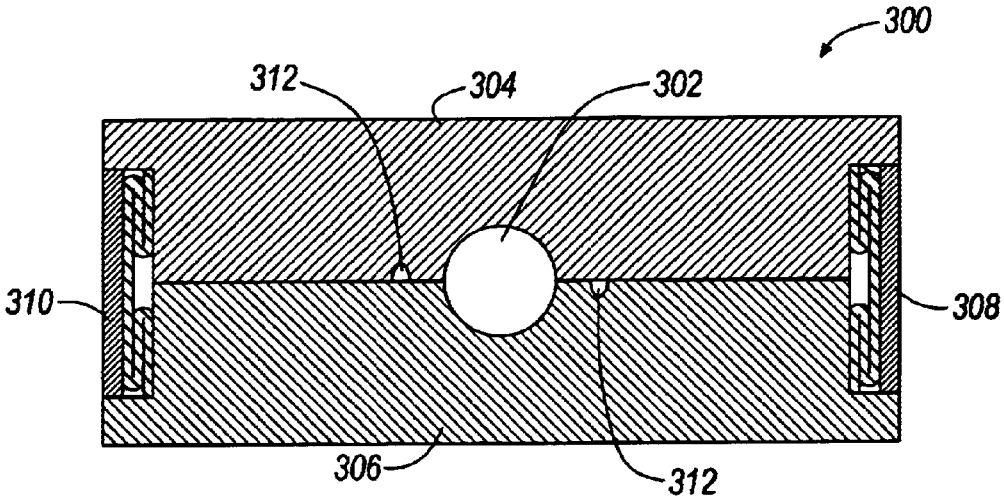
FIG. 16 is a sectional view of a fourth embodiment of a hydraulically adjustable manhole ring according to the present invention.
Figure 17:
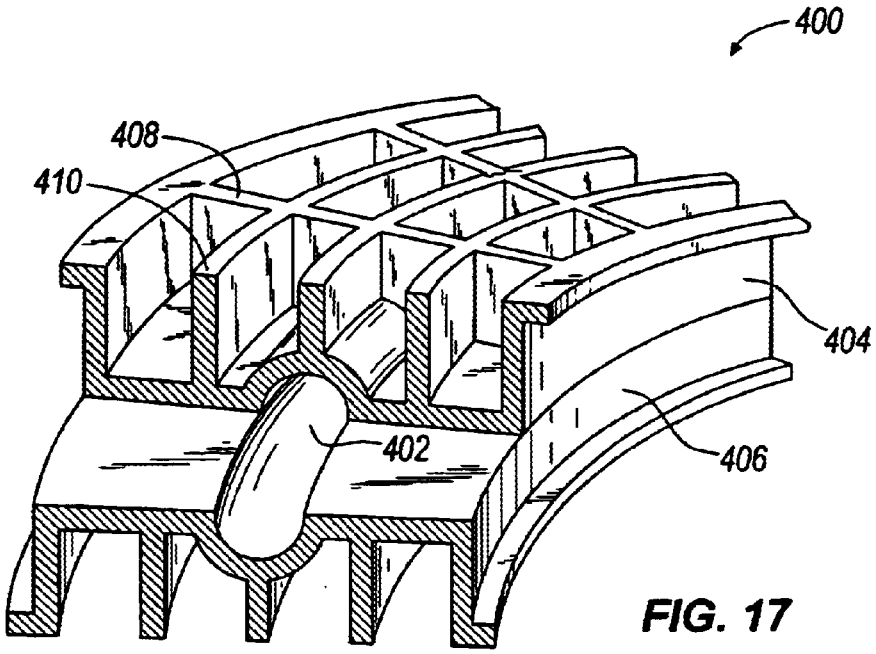
FIG. 17 is a perspective view with portions cut away of a fifth embodiment of a hydraulically adjustable manhole ring according to the present invention.

The hydraulically adjustable manhole ring 10 also includes a top ring or upper ring 42 (FIG. 5), which is also "doughnut" shaped and of approximately the same inner and outer diameters as the lower ring. A bottom surface 44 of the upper ring 42 is substantially flat and when placed on the bottom or lower ring 18 creates the cavity or channel 28 to accept the pressurized flowable setting agent. Inner and outer vertical edges 46 and 48, respectively, are also configured to facilitate fastening the upper edges of the inner and outer membranes 38 and 40. Both the upper and lower rings 18, 42 are made of a resilient material such as HDPE or PVC and preferably are of suitable strength to meet specifications for supporting the manhole frame 12. However, it will be readily understood by those of ordinary skill in the art that upper and lower rings 18, 42 may be solid or may contain voids or hollow areas to save on material and weight. Also, the cavity or channel 28 between the rings 18, 42 may be created in many different shapes and designs. For example, as shown in FIG. 16, another embodiment of a hydraulically adjustable manhole ring 300 according to the present invention includes a round cavity or channel 302 formed between upper and lower rings 304 and 306, respectively. Additionally, as shown in FIG. 17, still another embodiment of a hydraulically adjustable manhole ring 400 according to the present invention includes a round channel 402 between upper and lower rings 404 and 406, respectively. In this embodiment, both the upper and lower rings 404, 406 are formed to include a plurality of radial and circumferential ribs 408 and 410, respectively. In this embodiment, the upper and lower rings 404, 406 provide adequate strength to the hydraulically adjustable manhole ring 400 to support a manhole frame, but reduce the overall weight of the manhole ring 400.

Figure 5:
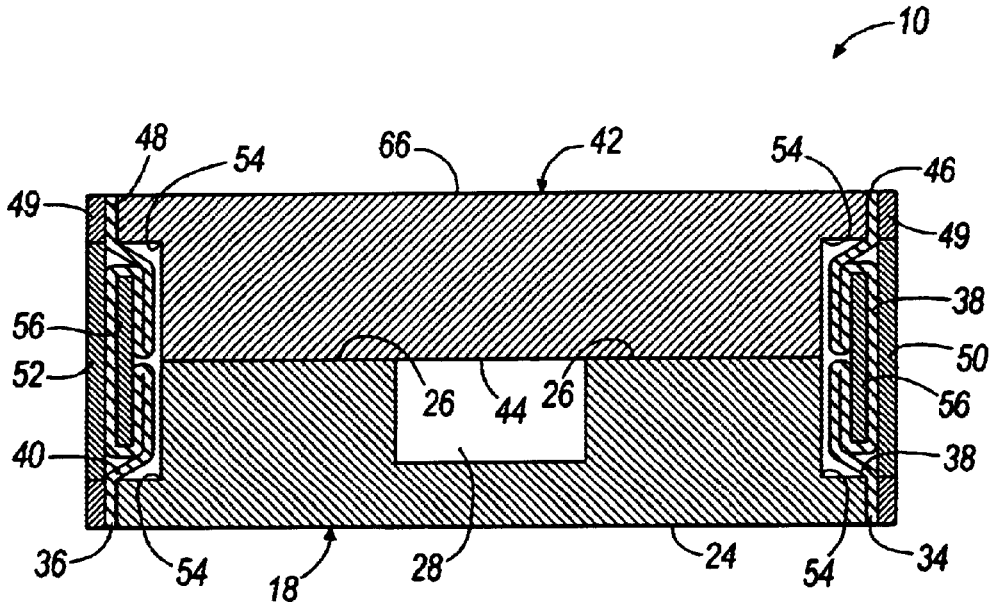
Figure 6:
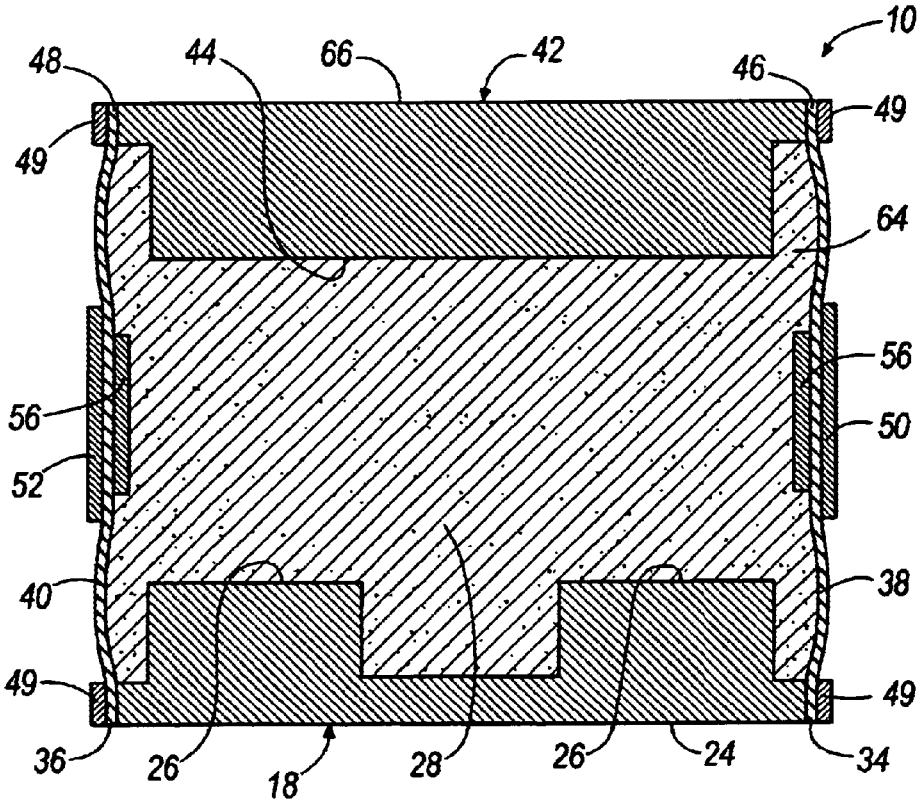
FIG. 6 is a sectional view of the manhole ring of FIG. 1 similar to FIG. 5, showing the manhole ring in an expanded position with a flowable setting agent injected between the upper and lower rings.

Referring to FIGS. 5 and 6, the inner and outer membranes 38 and 40 are fastened to the lower and upper rings 18 and 42 and designed such that when the hydraulically adjustable manhole ring 10 is in a lower position (FIG. 5), they fold inward. The membranes 38, 40 are of a rubber-like material such as EPDM and are flexible to allow movement of the top ring 42 upward through its operating range of adjustment. It will be readily apparent to those of ordinary skill in the art that flexible materials other than EPDM, such as various rubber materials, plastic materials, fabric materials, etc., may be used in the membranes. Additionally, the inner and outer membranes 38 and 40 do not need to be made out of the same material. For example, the inner membrane 38 could be made out of a material that allows moisture to escape, while the outer membrane 40 provides a water-tight seal. The membranes 38, 40 are fastened to the inner 34, 46 and outer 36, 48 edges of the upper and lower rings 18, 42 by adhesion, bonding, or mechanical means. For example, as shown in FIGS. 5 and 6, membrane fasteners 49 cooperate with inner 34, 46 and outer 36, 48 edges of the upper and lower rings 18, 42 to secure the membranes 38, 40. The membranes 38, 40 can be made of a flat sheet material and stretched to fold inward or extruded in a shape that will provide the desired fold.

The hydraulically adjustable manhole ring 10 further includes inner and outer lateral support bands or rings 50 and 52, respectively, which are cylindrical rings, each the approximate diameter of the inner 34, 36 and outer 36, 48 edges of the upper and lower base rings 18, 42. The lateral support provided by inner and outer lateral support bands 50 and 52 is not mandatory to the function of the adjustable manhole ring 10, but provides for enhanced operation, protection of the membrane, and gives the outward appearance of a solid unit. When the hydraulically adjustable manhole ring 10 is in the lower position, bands 56, which cooperate with the lateral support rings 50, 52, as described below, will dovetail into beveled edges 54 on the base rings 18, 42, so that the lateral support rings 50, 52 abut the membrane fasteners 49 to form the exterior appearance of a solid manhole ring. The lateral support bands 50, 52 are of a thickness and material to provide containment during the injection process and to protect the membrane from physical damage after it is installed. The lateral support bands 50, 52 are attached to the approximate midpoint of the membranes 38, 40 by adhesion, bonding or mechanical means. One such means is to provide additional, similar bands 56 of an appropriate diameter to frictionally secure the membranes 38 and 40 by "sandwiching" them between bands 56 and lateral support bands 50 and 52.

Figure 18:
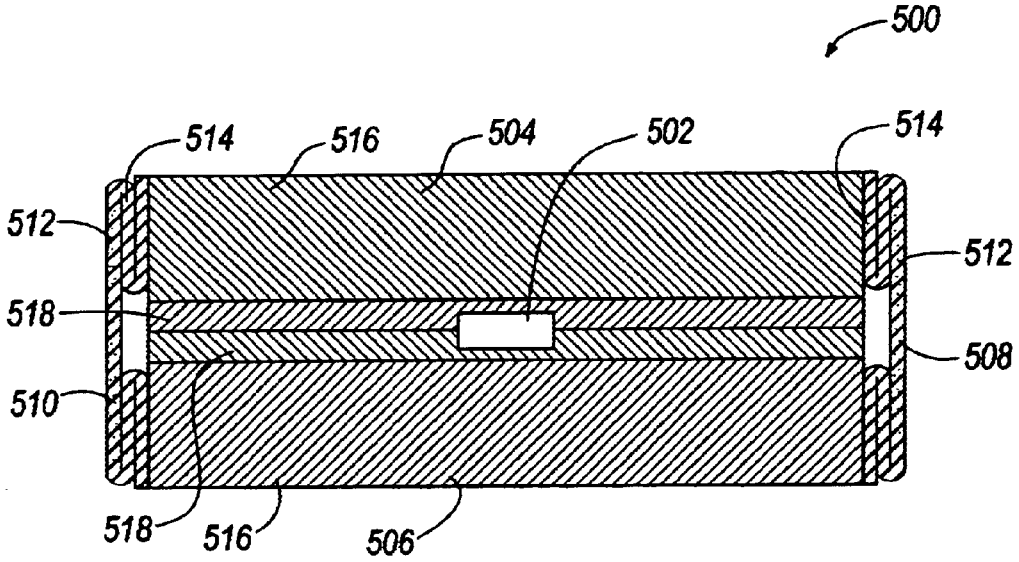
FIG. 18 is a sectional view of a sixth embodiment of a hydraulically adjustable manhole ring according to the present invention.

As shown in FIG. 18, in another embodiment of a hydraulically adjustable manhole ring 500 according to the present invention, no lateral support bands are used. Instead, inner and outer membranes 508 and 510, respectively, comprise a dual durometer extrusion wherein an outer support portion 512 of each membrane 508, 510 is of a greater density than a flexible portion 514. It will be readily understood by those of ordinary skill in the art that various configurations of membranes and lateral supports can be used. As shown in FIG. 16, only a single inner support band 308 and outer support band 310 are utilized.

The manhole ring 300 of FIG. 16 also illustrates the use of a guide grooves 312, which may be used to help align the upper and lower rings 304, 306 and prevent premature seepage of the setting agent between the rings 304, 306 until the entire channel 302 has been filled and the hydraulic pressure of the setting agent is suitable to lift the upper ring 304. The manhole ring 500 of FIG. 18 also illustrates a configuration where each of the upper and lower rings 504, 506 includes a standard ring portion 516 coupled to a cap portion 518. The cap portions 518 of the upper and lower rings 504, 506 are formed such that when positioned in a mirror-image relationship to each other they cooperate to create a channel 502 for receiving a flowable setting agent.

Figure 7:
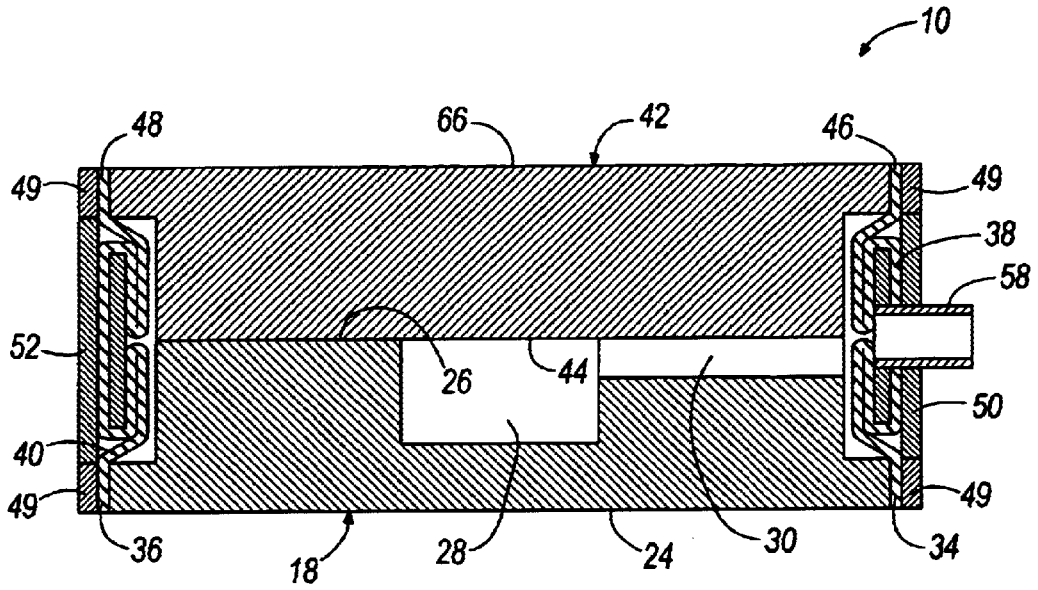
FIG. 7 is a sectional view of the manhole ring of FIG. 1 taken along line 7—7 of FIG. 4, showing an injection port communicating with an injection groove to provide an inlet to the channel.

Referring to FIG. 7, an injection port 58, providing a passageway through the inner lateral support band 50 and inner membrane 38 and to the injection groove 30, is fitted with a hose fitting to allow injection of the setting agent into the cavity 28. The injection port matches up with the injection groove 30 on the lower base ring 18. The fitting can be attached in any number of ways and must be of sufficient inner diameter to facilitate the flow of the injected setting agent 64.

Figure 8:
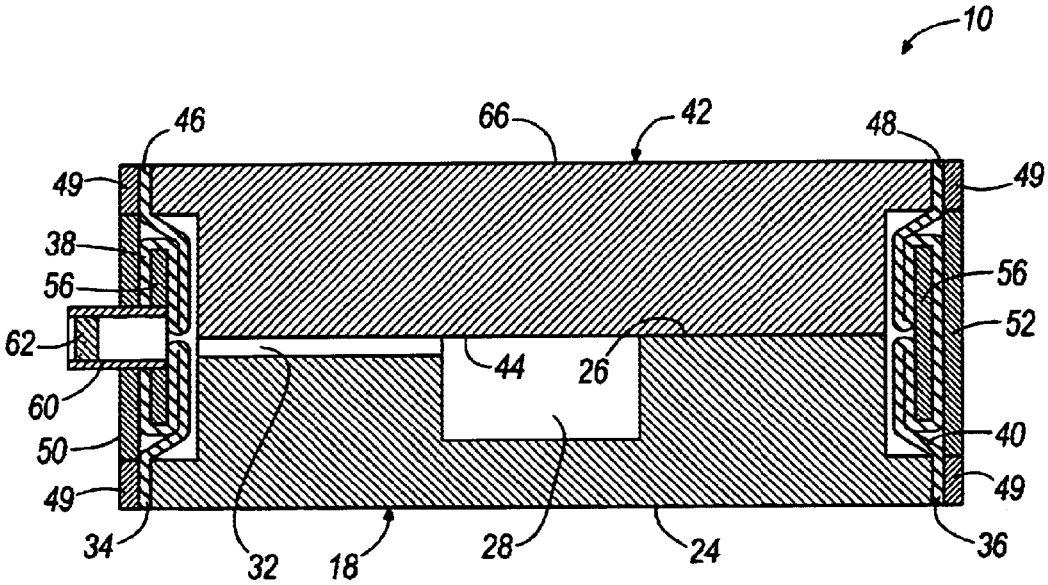
FIG. 8 is a sectional view of the manhole ring of FIG. 1 taken along line 8—8 of FIG. 4, showing a vent port communicating with an evacuation groove to provide an outlet from the channel.
Figure 9:
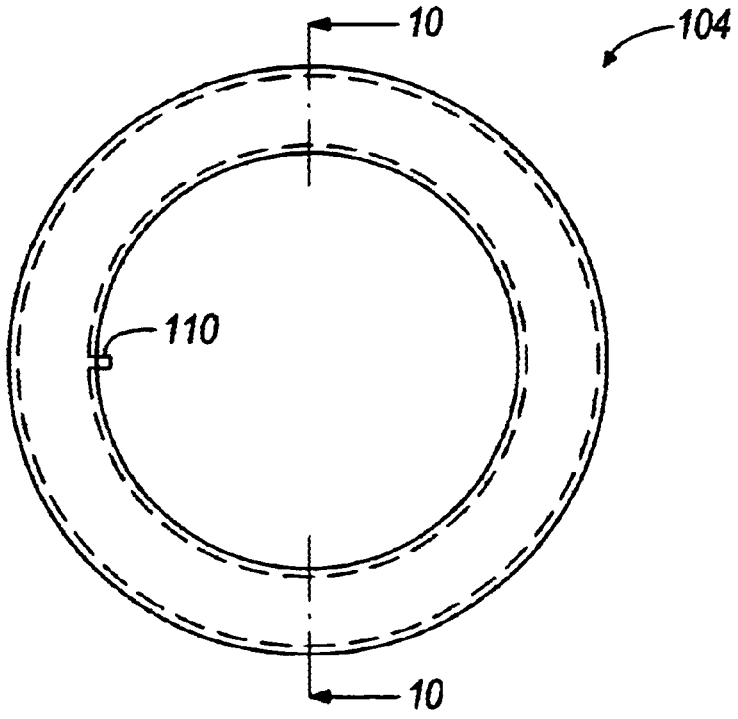
FIG. 9 is a top view of an upper ring of a second embodiment of a hydraulically adjustable manhole ring according to the present invention.
Figure 10:
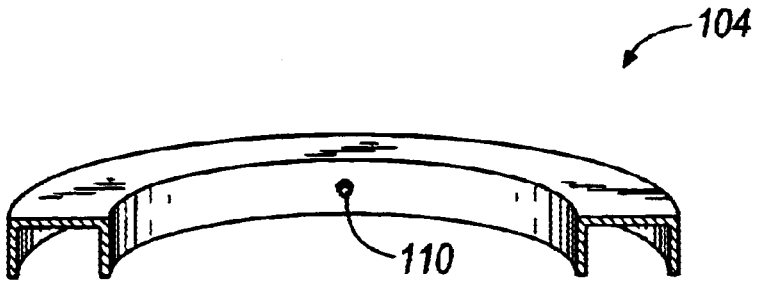
FIG. 10 is a perspective view of a portion of the upper ring of FIG. 10.
Figure 11:
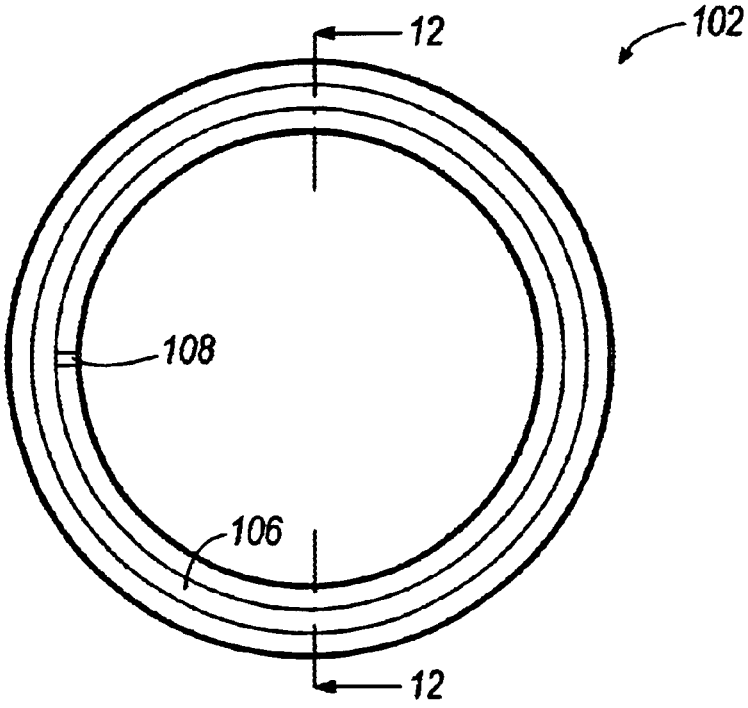
FIG. 11 is a top view of a lower ring that cooperates with the upper ring of FIG. 9.
Figure 12:
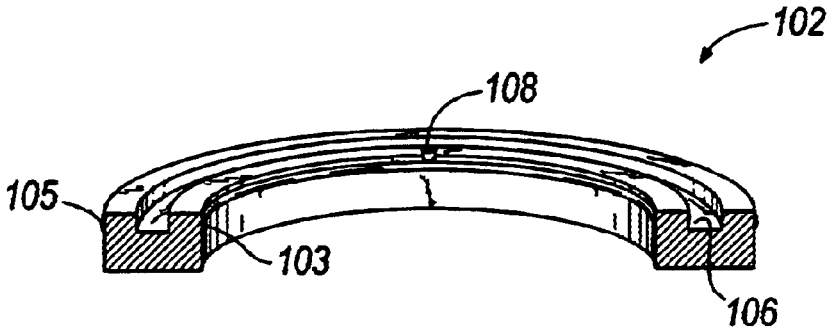
FIG. 12 is a perspective view of a portion of the lower ring of FIG. 11.
Figure 13:
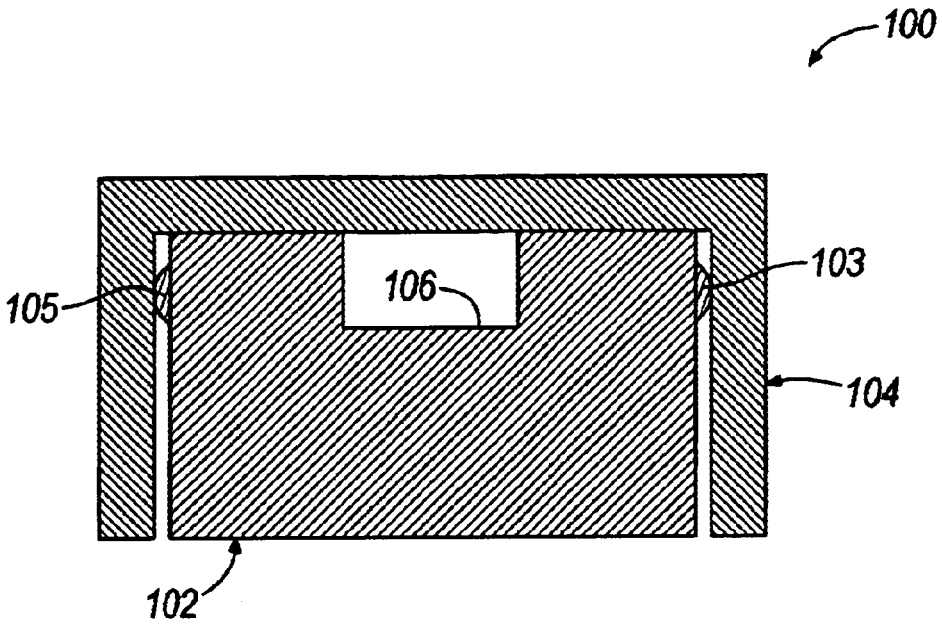
FIG. 13 is a sectional view of the upper and lower rings of FIGS. 9 and 11 cooperating to form the second embodiment of the hydraulically adjustable manhole ring.
Figure 14:
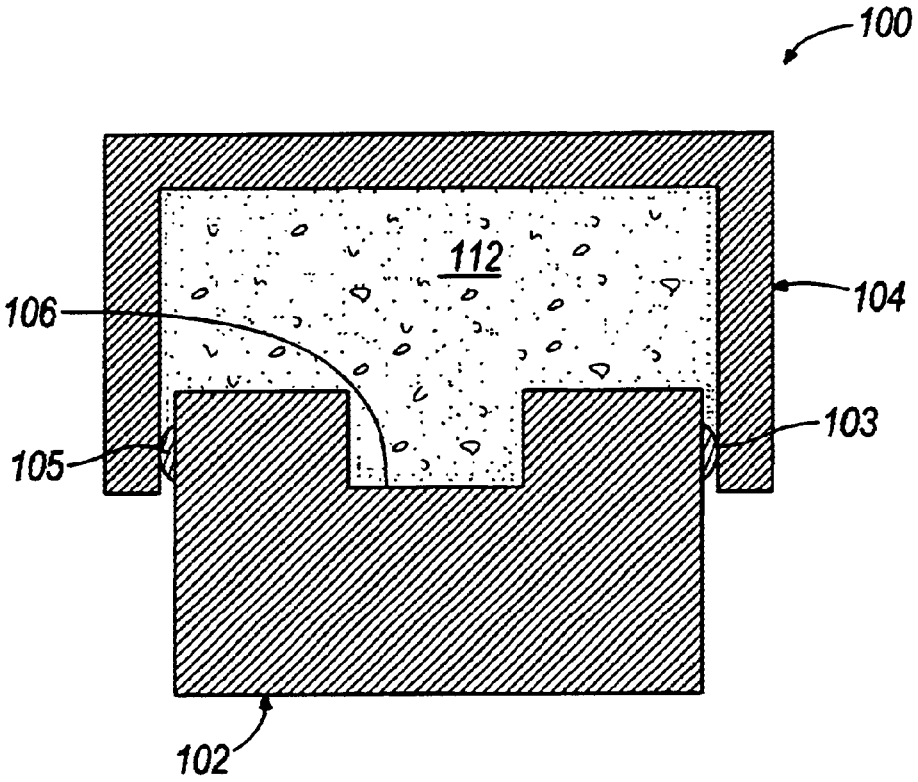
FIG. 14 is a sectional view similar to FIG. 13 in an expanded position with a flowable setting agent injected between the upper and lower rings.

Referring to FIG. 8, a vent port 60 also penetrates through the inner lateral support band 50 and inner membrane 38. The vent port 60 connects to the evacuation groove 32 to provide an outlet for air forced out during the injection process and, if necessary, an outlet for moisture released by the setting agent 64 as it sets. The vent port 60 also, at the same time, provides containment for the setting agent 64. As shown in FIG. 8, the vent port 60 includes a piece of coarse fabric 62 that allows air to pass through, yet contains the setting agent 64. However, the vent port 60 could also be provided without the coarse fabric 62, allowing the setting agent 64 to flow out of the vent port 60 until a cap (not shown) is placed on the vent port 60.

The initial installation of the hydraulically adjustable manhole ring 10 is similar to that of any common manhole adjustment ring. The hydraulically adjustable manhole ring 10 is placed on top of the manhole cone 14 or upper manhole adjusting ring 16 and the manhole casting/cover assembly or frame 12 is placed on top. A top surface 66 of the manhole ring 10 is placed at an elevation a distance below the desired finished elevation of the paved surface, but within the operating adjustment range. A butyl sealant may be used to adhere the bottom 24 and top 66 surfaces to the manhole 14 and the manhole frame 12, respectively.

To raise and adjust the frame 12 to its desired elevation to match the pavement surface, the manhole cover (not shown) is removed to allow access to the injection port 58. The manhole frame 12 is left in place. The setting agent 64 is then injected into the injection port 58. As the setting agent 64 flows into the channel or cavity 28 of the lower ring 18, air is displaced and forced by pressure out of the vent holes 60. When all air is displaced, the channel 28 is entirely filled with the setting agent 64 and the continued injection of the setting agent 64 builds up hydraulic pressure causing the upper ring 42 to move in an upward direction until the desired elevation and slope are achieved. When this occurs, the injection process is halted and the injection hose is closed, either by a valve, clamp, or other means. The proper slope or pitch adjustment is made by applying pressure on the edges of the manhole frame 12. When the desired position is obtained, the setting agent 64 is allowed to cure or set until it reaches acceptable strength. Then, the injection hose and fitting can be removed and discarded.

The injection process may be completed by any means, such as mechanical or hydraulic, that provides a pressure sufficient to force the setting agent 64 into the channel 28 and lift the frame 12 and cover. One possible means would be to use a pressurization vessel capable of containing a separate vessel of sufficient volume (e.g., a six- or seven-gallon pail) to contain a sufficient amount of the setting agent 64. The required amount of setting agent mixture would be placed into the pail and inserted into the pressurization vessel. The top of this vessel would be fitted with an air valve and a pipe extending through it to near the bottom of the bucket. A hose would be connected from this pipe to the injection port 58 and air pressure would be applied, forcing the setting agent to enter the injection port 58. Any air within the hose and the cavity or channel 28 would be forced out of the vent holes 60 until the cavity 28 is completely filled. Pressure would continue to be applied causing the upper base ring 42 to lift and a cement adjusting ring to form, in situ, between the top ring 42 and the bottom ring 18. As previously described, the frame 12 is then adjusted to the slope of the surrounding road surface using external pressure and the injection hose is clamped or valved to maintain the adjustment.

Figure 19:
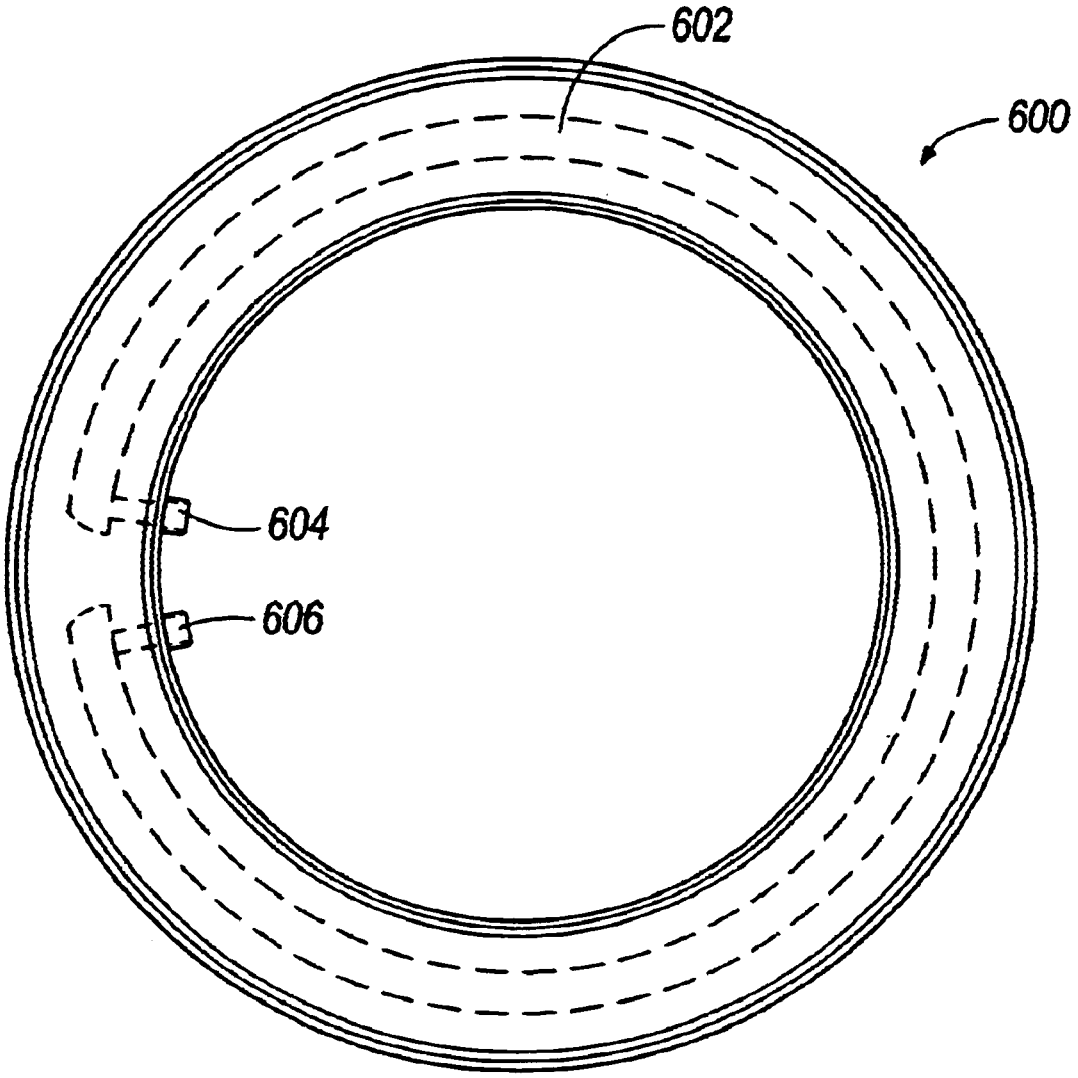
FIG. 19 is a top view of a seventh embodiment of a hydraulically adjustable manhole ring according to the present invention.

Referring to FIG. 19, another embodiment of a hydraulically adjustable manhole ring 600 according to the present invention includes an injection port 604 positioned on the same side of the manhole ring 600 as a vent port 606. In this arrangement, a flowable setting agent injected into the manhole ring 600 flows in substantially one direction through a channel or cavity 602 to ensure that the entire channel 602 is filled with the setting agent before the setting agent exits the vent port 606. A vacuum may be drawn at the vent port 606 to aid the flow of the setting agent and draw it around the manhole ring 600.

A hydraulic adjusting ring according to the present invention can also be used to lift and adjust other types of castings and frames such as rectangular catch basins, and other structures including, but not limited to, building walls. The top and bottom rings can be designed to be substantially identical to simplify fabrication and reduce production costs. In this way, the rings can be formed so that when one ring is inverted and placed on top of the other ring, they mate to form the top and bottom rings of the hydraulic adjusting ring of the present invention. Fabrication of the top and bottom rings can be as one piece units, or separate components fastened together to achieve the desired configuration (e.g., FIG. 18). The cavity or channel can be configured in many shapes, but the hydraulically adjustable manhole ring 10 must provide sufficient strength in the unexpanded mode to meet load bearing standards for the particular application. According to the present invention, a hydraulic adjusting ring may be modified to facilitate the incorporated use of internal and/or external manhole chimney sealing devices, such as CRETEX manhole boots.

Referring to FIGS. 9–14, another embodiment of a hydraulically adjustable manhole ring 100 according to the present invention is shown. This embodiment comprises a base ring or lower ring 102 similar in size and shape to a conventional manhole ring, and an inverted channel shaped ring or upper ring 104 sized to snugly fit over the base ring 102. The base ring 102, on its top surface, has a deep channel or cavity 106, approximately 1" deep by 2" wide (of course other dimensions and shapes other than a 1" by 2" rectangle can be used), about midway around its circumference. At one point, the channel 106 extends in a radial groove 108 to the inside edge of the base ring 102. One or more smaller grooves are located at points opposite the larger radial groove 108 to provide an air release during the initial introduction of a flowable setting agent 112. The upper ring 104 is an inverted channel, like an upside down food cake pan, flat on the top, with vertical sides, both inner and outer, that snuggly fit over the base ring 102. Inner and outer seal rings, 103 and 105, respectively, are coupled to the base ring 102 to facilitate a snug fit with the upper ring 104. The vertical sides of the upper ring 104 extend down to the bottom of the base ring 102, but could extend further if needed. The inside wall of the upper ring has a hole 110, lined up with the radial groove 108 of the lower ring 102 to facilitate injection of the setting agent 112. Smaller holes are drilled to correspond with the air bleed grooves. The upper ring 104 may have a lip at the bottom inside edges to limit its upward movement. The base ring 102 will protrude on the upper inside and outside edges to facilitate a seal, and allow tilting of the upper ring 104. The adjustable manhole ring 100 is installed between the manhole frame and adjusting ring (conventional) or cone. Using suitable fittings and a pump, the flowable setting agent 112 is injected into the hole 110 of the upper ring 104 and into the channel 106 of the lower ring causing air to evacuate the bleed holes and fill the channel 106. It will be readily apparent to those of ordinary skill in the art that the flowable setting agent 112 may be injected into the hole 110 by means other than a pump. Simple gravitational means or pressure-applying devices other than a pump can be used.

The base ring 102 outer circumference could be greater than a standard concrete or plastic adjusting ring, allowing the vertical walls of the upper ring to extend beyond the bottom of the base ring, to allow a greater vertical lift distance. More than one injection point may be utilized to provide an evenly distributed lift around the circumference of the ring assembly 100. The injection port and grooves may be configured to allow any accumulated water to drain prior to injection. The air bleed hole(s) may be plugged, either manually or automatically, to prevent mortar 112 from escaping. The material used for injection can be cementitious mortar, epoxy or other fluid. A lip may be provided on the inner bottom edges of the upper ring to provide a stop mechanism and limit the upward movement of the upper ring. This may also be accomplished by using strapping fastened to the base 102 and upper 104 rings. The relational size between the base and upper rings 102, 104 is such that a seal is maintained during injection of grout 112, and the upward movement of the upper ring 104 is not impeded.

Figure 15:
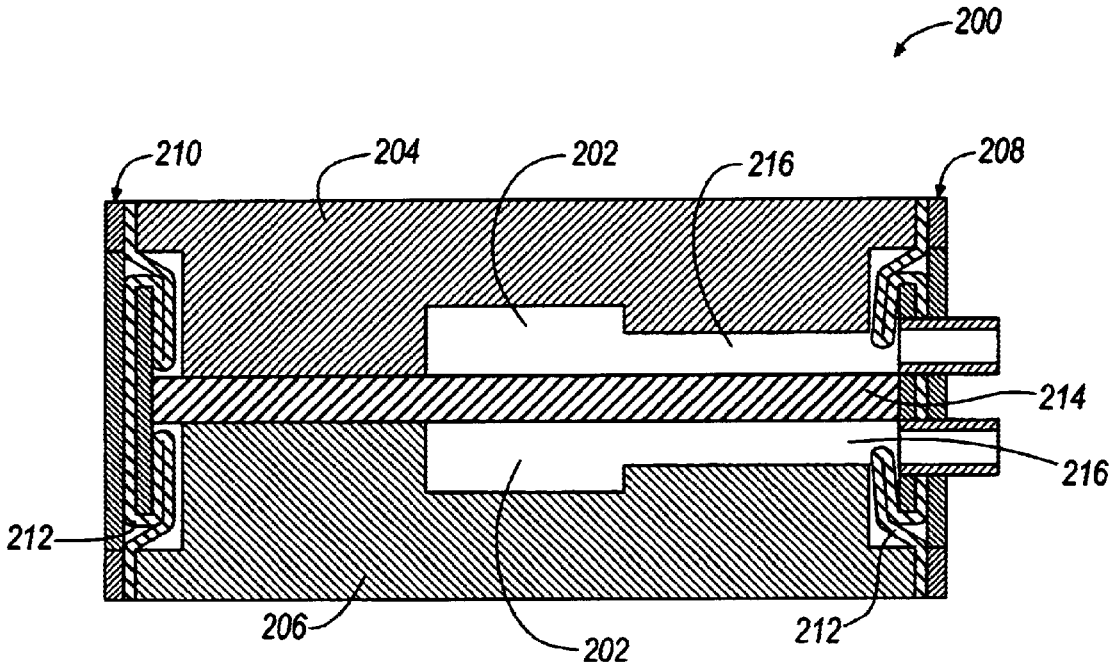
FIG. 15 is a sectional view of a third embodiment of a hydraulically adjustable manhole ring according to the present invention.

Referring to FIG. 15, yet another embodiment of a hydraulically adjustable manhole ring 200, according to the present invention, is shown. This embodiment comprises two or more separate but attached channels or cavities 202 to allow multiple, sequential adjustments of the manhole frame. The manhole ring 200 consists of a top ring or upper ring 204 and a lower ring or bottom ring 206 connected on both the inner 208 and outer 210 circumferences with a flexible membrane 212 to provide containment for a flowable setting agent. A divider ring 214 is sandwiched between the top and bottom rings 204, 206 and is fastened along its inner and outer circumference to the flexible membrane 212. Both the top ring 204 and the bottom ring 206 have an injection groove 216 and grooves (not shown) extending radially to the inner circumference 208 to independently facilitate the injection of a flowable setting agent and the venting of air, respectively, for each chamber.

The operation of this embodiment is similar to the previously described operation, except that each channel or cavity 202 can be pressurized independently of the other(s) to allow for subsequent manhole frame adjustments.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

What is claimed is:

1. A manhole ring comprising:

an upper ring having an outer circumference and an inner circumference, a lower ring having an outer circumference and an inner circumference, an outer flexible membrane having a first end coupled to the outer circumference of the upper ring and a second end coupled to the outer circumference of the lower ring, an inner flexible membrane having a first end coupled to the inner circumference of the upper ring and a second end coupled to the inner circumference of the lower ring, the outer and inner flexible membranes allowing movement of the upper and lower rings relative to each other, and a channel positioned between the upper ring and the lower ring, the channel formed to receive a flowable setting agent.

2. The manhole ring of claim 1, wherein the channel is formed in the lower ring.

3. The manhole ring of claim 1, wherein the upper ring and the lower ring cooperate to form the channel.

4. The manhole ring of claim 3, wherein the upper and lower rings are substantially identical, the upper ring being inverted and positioned on top of the lower ring.

5. The manhole ring of claim 1, wherein the outer flexible membrane comprises rubber.

6. The manhole ring of claim 1, wherein the flowable setting agent is cement.

7. The manhole ring of claim 1, wherein the inner and outer flexible membranes are couple to the upper and lower rings using adhesive.

8. A manhole ring comprising:

a lower ring having an outer circumference and an inner circumference, an upper ring having an outer circumference and an inner circumference, a channel formed between the upper and lower rings to receive an flowable setting agent, an inner seal between the inner circumference of the lower ring and the inner circumference of the upper ring, the inner seal allowing movement of the upper and lower rings with respect to each other, the inner seal further preventing the passage of the flowable setting agent, and an outer seal between the outer circumference of the lower ring and the outer circumference of the upper ring, the outer seal allowing movement of the upper and lower rings with respect to each other, the outer seal further preventing the passage of the flowable setting agent.

9. The manhole ring of claim 8, wherein the inner and outer seals comprise flexible membranes.

10. The manhole ring of claim 9, wherein the flowable setting agent comprises cement.

11. The manhole ring of claim 8, wherein the inner and outer seals comprise rubber gaskets.

12. The manhole ring of claim 11, wherein the flowable setting agent comprises cement.

* * * * *